US007264854B2

(12) United States Patent
Stroppiana

(10) Patent No.: US 7,264,854 B2
(45) Date of Patent: Sep. 4, 2007

(54) PROCESS FOR PRODUCING SYNTHETIC-GRASS STRUCTURES AND CORRESPONDING SYNTHETIC-GRASS STRUCTURE

(75) Inventor: Fernando Stroppiana, Cuneo (IT)

(73) Assignee: Mondo S.p.A. (IT)

( * ) Notice: Subject to any disclaimer, the term of this patent is extended or adjusted under 35 U.S.C. 154(b) by 540 days.

(21) Appl. No.: 10/460,549

(22) Filed: Jun. 11, 2003

(65) Prior Publication Data

US 2004/0037975 A1 Feb. 26, 2004

(30) Foreign Application Priority Data

Jun. 17, 2002 (EP) ..... 02425398

(51) Int. Cl.
*A41G 1/00* (2006.01)

(52) U.S. Cl. ..... 428/17; 428/85; 428/87; 428/92; 156/279

(58) Field of Classification Search ..... 428/15, 428/17, 25, 26, 542.6; 273/DIG. 13; 404/17, 404/71; 156/279
See application file for complete search history.

(56) References Cited

U.S. PATENT DOCUMENTS 3,940,522 A * 2/1976 Wessells ..... 428/17
4,061,804 A * 12/1977 McCulloch ..... 428/17
4,337,283 A * 6/1982 Haas, Jr. ..... 428/17
4,389,435 A * 6/1983 Haas, Jr. ..... 428/17
5,958,527 A 9/1999 Prevost ..... 428/17
6,746,752 B2 * 6/2004 Prevost ..... 428/143
6,946,181 B2 * 9/2005 Prevost ..... 428/87
2004/0058096 A1 * 3/2004 Prevost ..... 428/17

FOREIGN PATENT DOCUMENTS

| | | |
|---|---|---|
| EP | 0 259 940 A2 | 3/1988 |
| EP | 0 301 843 A1 | 2/1989 |
| EP | 1 158 099 A2 | 11/2001 |
| JP | 07158008 | 6/1995 |
| WO | WO 01/48322 A1 | 7/2001 |

* cited by examiner

*Primary Examiner*—John J. Zimmerman
*Assistant Examiner*—Aaron Austin
(74) *Attorney, Agent, or Firm*—Dorsey & Whitney LLP

(57) ABSTRACT

A synthetic-grass flooring may include a substrate with multiple filiform formations extending upwards from the substrate to simulate natural-grass cover or turf. End portions of the filiform formations may be curled to bestow upon the filiform formations a general tree-like conformation. The synthetic-grass flooring may be manufactured as a finished product in a factory. A particulate filling material or infill may be retained on the substrate by the curly ends of the filiform formations.

31 Claims, 2 Drawing Sheets

Figure 1:
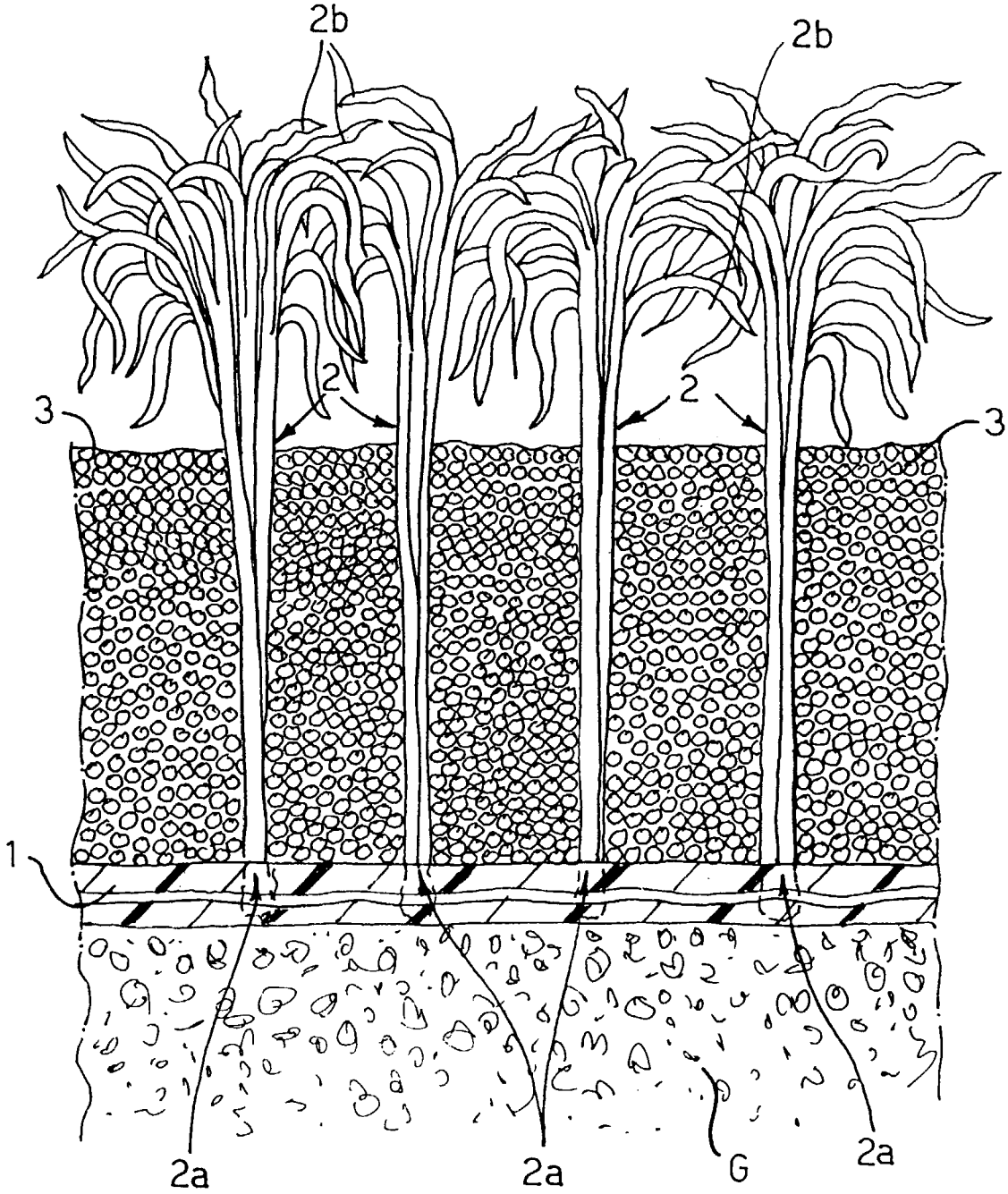

PROCESS FOR PRODUCING SYNTHETIC-GRASS STRUCTURES AND CORRESPONDING SYNTHETIC-GRASS STRUCTURE

CROSS REFERENCE TO RELATED APPLICATION

This application claims priority to European Patent Office Application Number 02425398.1, filed Jun. 17, 2002, which is incorporated herein by reference in its entirety.

The present invention relates to synthetic-grass structures of the type comprising a substrate with a plurality of filiform formations that extend upwards starting from the substrate itself so as to simulate natural-grass cover or natural turf. Synthetic grass structures of the type described above can be used both as products in themselves and in structures where, between the filiform formations that simulate natural-grass cover, there is dispersed a particulate filling material designed to maintain the filiform formations themselves in a substantially upright condition.

Solutions of this sort are described, for example, in U.S. Pat. No. 5,958,527 or EP-A-1 158 099. In particular, in the solution described in the latter document, the particulate filling material, or infill, is made up of a substantially homogeneous mass of granular plastic material.

The synthetic-grass structures considered previously (whether these be solutions that do not envisage the use of filling material (infill), or, and above all, solutions that do envisage the use of the aforesaid infill) are increasingly considered as being a valid alternative to natural-grass cover. This, in particular, as regards applications in which, for different reasons (environmental conditions, intense use, etc.), upkeep of natural turf proves to be a critical problem, also as regards the maintenance costs involved. For example, there is known the use of grass structures of the type described for making sports fields such as football fields, five-a-side football fields, American-football fields, and tennis courts. The use of grass structures of this type is also envisaged for providing athletics tracks.

With a certain degree of approximation, but with substantial adherence to reality, in making and laying synthetic-grass floorings of the type described, it is necessary to take into account at least three basic categories of factors.

In the first place, it is desirable for the synthetic grass to present an appearance as close as possible to the appearance of a natural-grass cover or natural turf. In other words, it is desirable that a synthetic-grass cover should not reveal too evidently its nature. For this reason, after the synthetic-grass flooring has been laid, it is frequently treated by direct brushing aimed at breaking up in the sense of a general fibrillation the filiform formations of the substrate so as to render them as far as possible similar to blades of natural grass. Once again with the same aim in view, the solution of making the synthetic grass using filiform formations previously subjected to a treatment of curling or texturing (according to a term currently used in the sector of textile yarns) has been proposed and adopted in practice. This solution, however, comes up against two sorts of difficulties. On the one hand, in fact, in order to make a sheet substrate with a plurality of filiform formations extending from the substrate using a curled or textured yarn raises a great deal of difficulties of a technological nature. In the second place, a substrate of this type cannot practically be used in combination with an infill given that it is very difficult and, in effect, impossible to "sow" the infill into the dense network constituted by the curly or textured filiform formations.

A second category of factors that must be taken into account is linked to the wear of the synthetic-grass cover during use. In the absence, in fact, of the mechanism of regrowth of natural-grass cover, synthetic-grass floorings tend to wear out (or, at the very least, to undergo serious alterations) in a far from uniform way according to the different conditions of use and the stresses to which different areas of the flooring may be subjected. In order to provide an example that is immediately understandable, it may readily be appreciated that, in the case of a flooring for playing football, the central area of the pitch and the areas around the goal-mouth tend to undergo greater stresses and hence to wear out to a more marked extent than do the other areas such as the areas located near to the corners of the pitch or the areas immediately at the sides of the goals. In the case of synthetic-grass cover where infill is used, it is necessary to take into consideration that some types of stresses may lead the infill to be knocked out of the place where it is located. As a typical example, the case of an athlete may be considered who is wearing shoes with studs or spikes and who exploits the said studs or spikes to exert a strong thrust forwards or perform a sharp deceleration. Usually, the filiform formations of the grass cover do not provide an appreciable action of anchorage in regard to the infill when the infill is subjected to such intense stresses.

Finally, a third set of factors to be taken into consideration is strictly linked to the laying of the synthetic-grass flooring. In particular, when synthetic-grass floorings are involved which envisage the use of infill, current practice is to lay first the sheet substrate provided with filiform formations simulating natural-grass cover and then to "sow" said cover with particulate infill.

The above operation carried out "in field" is, of course, open to various critical factors. Just to mention a few examples, when "sowing" the particulate infill, it is usually preferable to intervene first on the filiform formations in such a way that, when they are sown with the infill, they are oriented in a substantially vertical direction. The purpose of this is to enable the particulate material to deposit gradually starting from the lowest level adjacent to the ground. Furthermore, exact dosage of the amount of particulate material deposited per unit surface requires the availability of special equipment and, in general, specialized staff. In the case where the infill material is a plastic polymer material, other factors may also be involved, such as ones linked to the temperature at which "sowing" of the infill is carried out.

The purpose of the present invention is to provide a solution capable of overcoming, in a decisive way, the critical problems outlined above.

In accordance with the present invention, the above purpose is achieved thanks to a process having the characteristics recalled specifically in the ensuing claims.

The invention also refers to a corresponding synthetic-grass cover.

In particular, the solution according to the invention makes it possible to provide a synthetic-grass covering which (both in the case where use of an infill is envisaged and in the case where use of said material is not envisaged) presents an appearance very similar to that of natural-grass cover, without requiring accessory treatment such as combing or fibrillation, as referred to previously.

In the second place, the solution according to the invention makes it possible to provide a synthetic-grass covering which is characterized by an excellent resistance to mechanical loads, above all as regards mechanical loads exerted by treading, to which a synthetic-grass flooring is subjected in particular when used for sports events.

Furthermore, in the implementation of synthetic-grass floorings which envisage the use of an infill, the solution according to the invention enables the filiform formations designed to simulate natural-grass cover to provide an action of containment or of retention of the particulate infill.

The above factor proves of importance for at least two basic reasons.

In the first place, the incidence of phenomena linked to the possible uprooting of the infill as a result of mechanical stresses, such as those due to the loads applied by an athlete wearing footwear provided with studs or spikes, is considerably reduced, if not virtually eliminated.

What is more, the solution according to the invention enables "sowing" of the substrate with particulate infill when the synthetic flooring is being manufactured, consequently before proceeding to laying the synthetic-grass flooring itself. The solution according to the invention makes it possible to provide at the level of the manufacturing process, and hence in the factory, a synthetic-grass flooring which comprises both the sheet substrate with the filiform formations designed to simulate natural turf and the particulate infill dispersed between the filiform formations themselves in a substantially upright condition. The operation of "sowing" the particulate material carried out at the level of the manufacturing process may be done in a more precise and more controlled way than can be achieved via in-field "sowing" after laying of the sheet substrate with the filiform formations.

Specifically, the solution according to the invention makes it possible to obtain—as product leaving the factory—a synthetic-grass flooring which comprises both the sheet substrate with the filiform formations and the particulate infill dispersed amongst the filiform formations, it being possible for the said synthetic-grass flooring to be made in the form of sheets possibly wound in rolls.

The operation of laying the synthetic-grass flooring is consequently considerably simplified, in so far as it amounts to the operation of unrolling and laying the said synthetic-grass flooring on the ground, without any need to perform further operations. In carrying out the above laying operation, it is possible to rely upon a synthetic-grass flooring which, since it has been completely made in an industrial context, benefits from the fact that it must meet standards of production and of quality that are difficult to achieve, if not downright impossible to achieve, with a laying process of a traditional type.

Figure 2:
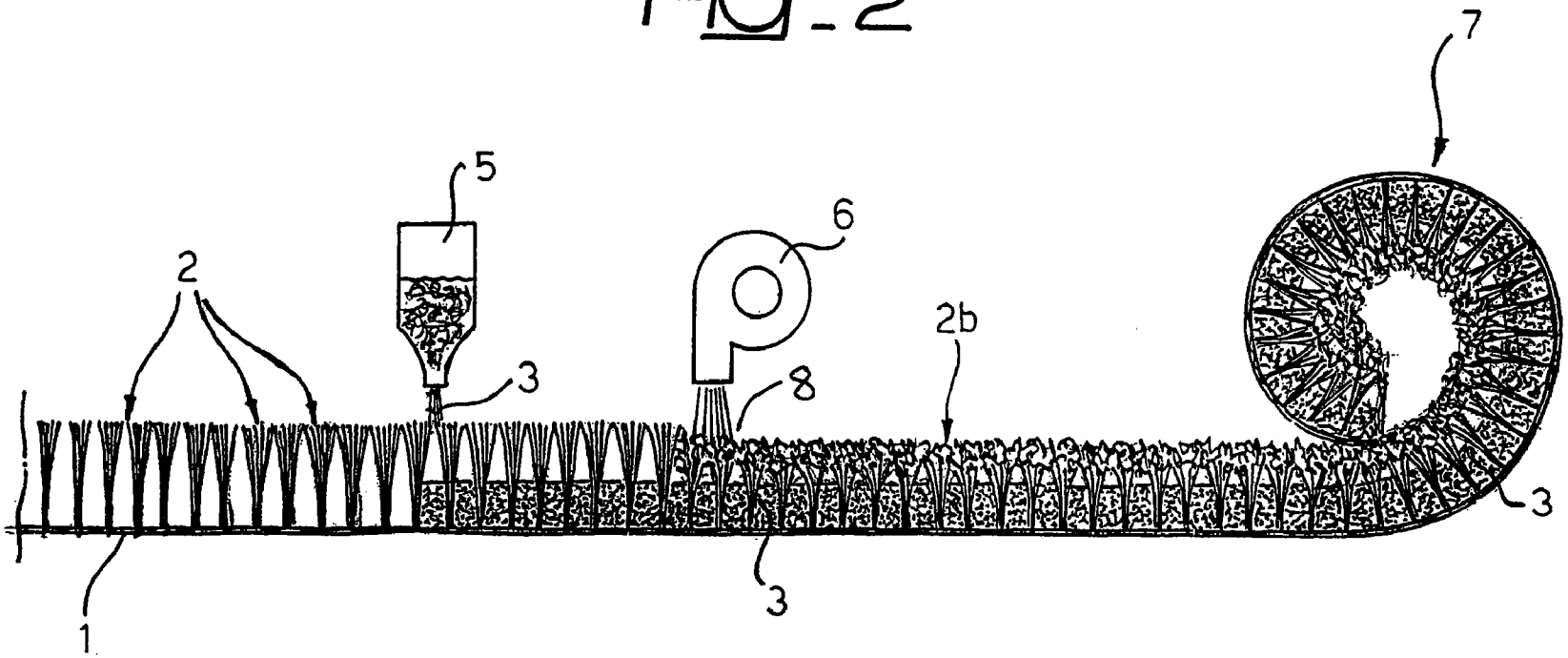

The present invention will now be described, purely by way of non-limiting example, with reference to the attached drawings, in which:

FIG. 1 reproduces schematically an idealized vertical section of a synthetic-grass structure according to the invention; and FIG. 2 illustrates an example of a process for making the synthetic-grass structure illustrated in FIG. 1.

Illustrated in FIG. 1 is a synthetic-grass flooring comprising a sheet substrate 1 designed to be laid on a subfloor G, which, in the most typical condition of use, consists of a subfloor made of tamped earth or of a bituminous mat, over which the synthetic-grass cover is laid usually in free-laying conditions.

The sheet substrate 1 may be made up of a sheet of plastic material, such as a non-woven fabric, rubber-backed with the application, for example, of latexes, such as SBR or polyurethane latexes. To the substrate in question, there may advantageously be associated, on the side designed to face the subfloor G, a layer of foamed material, for example a polyurethane-based foam material.

Starting from the substrate 1, a plurality of filiform formations 2 extend upwards, the said filiform formations being usually arranged in tufts so as to resemble more closely the blades of grass of natural-grass cover.

The filiform formations 2 are anchored to the substrate 1 at their proximal ends, designated by 2*a*, and extend upwards with their distal ends for a total length measured starting from the general plane of extension of the substrate 1 which may typically be in the 10-mm to 80-mm range, according to the applications envisaged. The quantitative data given above have, of course, a purely indicative nature.

According to an important characteristic of the invention, which will be illustrated in greater detail in what follows, instead of presenting an overall rectilinear pattern, the distal ends 2*b* have a twisted or "curly" pattern.

Consequently, the filiform formations 2 are ordered into tufts that present a general conformation that could be defined as "tree-like".

The aforesaid "tree-like" formations may, therefore, be distinguished into:

- a stem or trunk part adjacent to the proximal end 2*a* and following an overall rectilinear pattern; and
- a top part, which defines the distal end 2*b* having a curly pattern, as mentioned previously.

Except for the appearance of the distal ends 2*b*, an appearance to which we shall return later, the general criteria for making the substrate 2 and the filiform formations 2 (including the modalities for obtaining firm anchorage of the proximal ends 2*a* of the filiform formations 2 to the substrate 1) are known to the art, and hence do not require a detailed description herein, also because they are of themselves not important for the purposes of understanding the present invention.

As regards the choice of material constituting the filiform formations 2, the orientation is towards polyolefin materials, such as polyethylenes or polypropylene, or, more in general, any plastic material that can undergo processes of extrusion, spinning and/or drawing, so as to give rise to filaments capable of simulating the appearance of blades of grass of natural sward.

The materials referred to above are, moreover, usually characterized by the fact that they can be pigmented relatively easily using pigments that can be introduced into the material for forming the filiform formations in order to give rise to a bulk colouring, which is maintained in a practically constant way even after a prolonged use of the synthetic-grass flooring.

In general, apart form the overall "tree-like" configuration, the absolute and relative dimensions of the filiform formations 2, measured in the direction orthogonal to the plane of extension of the substrate 1, are not in themselves of particularly critical importance as regards the implementation of the invention. The choice of particular dimensional values, whether absolute ones or relative ones, is thus determined principally by the purpose to which the flooring in question is to be put.

Purely by way of indicative example, as regards applications in the sector of sports facilities, use of the said synthetic-grass flooring for tennis courts will thus tend to privilege embodiments with thin sward, whereas in the case of soccer pitches or American-football pitches, the choice will preferably favour embodiments with thicker sward.

In the exemplary embodiment of the invention illustrated herein (which, it is recalled, is provided purely by way of example) on top of the substrate 1, and hence amongst the filiform formations 2, there is dispersed a particulate or granular material (the two terms "particulate" and "granular" being used herein as synonyms), which functions as a filling material or infill 3. The function of the material 3 is basically that of keeping the filiform formations 2 in the upright condition, i.e., preventing them from undesirably lying down flat on the substrate 1.

Once again it is emphasized that the invention is in itself applicable also to the implementation of synthetic-grass floorings in which the use of the particulate material 3 is not contemplated, and consequently grass floorings made up basically only of the substrate 1 and the filiform formations 2.

If present, the particulate material 3 is dispersed amongst the filiform formations 2 in a sufficient amount to enable the filiform formations 2 to be supported by the infill 3 practically for the entire extent of the rectilinear portion of the bushy structure.

Preferably, the particulate infill material 3 is a substantially homogeneous material dispersed on top of the substrate 1 and amongst the filiform formations 2 in a substantially uniform way, without giving rise to superimposed layers having markedly different characteristics.

In the currently preferred embodiment of the invention, the aforesaid particulate material is a granular material with a grain size of less than 5 mm, ranging typically between 0.5 and 4.5 mm, and more preferably still between 0.5 and 3 mm, with a density ranging typically between 0.9 and 1.6 grams/$cm^3$.

According to criteria that are, on the other hand, already known from EP-A-1 158 099, the material of the infill layer may advantageously be a polyolefin material, such as polyethylene, and, even more preferably, a recycled polyolefin material, such as recycled polyethylene.

As variant, the aforesaid material may consist of a vinyl polymer, and, even more preferably, of recycled vinyl polymer.

The choice of the infill material 3, the modalities of distribution (thickness or depth of the infill layer 3, grain size of the material, etc.) chiefly determine the characteristics of hardness/compliance of the sward. As in the case of other types of flooring and, in particular, floorings designed for use in sports facilities, the aforesaid characteristics of hardness/compliance of the synthetic-grass flooring may be identified in a quantitatively precise way by resorting to the elastic-impact test forming the subject of the DIN standard 18035/6. This standard, together with the standard DIN 18032/2, enables definition of a parameter or coefficient known as KA (abbreviation of the German word "Kraftabbau").

The coefficient KA basically corresponds to a characterization, in percentage terms, of the behaviour of a flooring subjected to the fall of a heavy object of normalized dimensions as compared to the behaviour manifested in regard to the same load by a rigid surface typically made of cement.

In any case, the specific criteria that enable a synthetic-grass structure, such as the one illustrated in the drawings, to have a given value of the coefficient KA does not constitute a specific subject of the present patent application; consequently, a detailed description of the said criteria will not be provided herein.

The diagram of FIG. 2 illustrates a process that can be adopted for making a synthetic-grass flooring of the type illustrated in FIG. 1.

The starting point of the process is represented by a sheet substrate 1 provided with a plurality of filiform formations 2 having a substantially rectilinear pattern, which extends from the substrate and is designed to simulate natural-grass cover or turf.

Starting materials 1, 2 of the type to which reference will be made herein are known and currently available on the market. Purely by way of example, it is possible to cite the materials sold under the trade names: Mondoturf (manufactured by Mondo); Astro Turf, Astro Play and Astro Grass (manufactured by Astroturf); Field Turf (manufactured by Field Turf); Megagrass, Monotex, Monoslide, Terragreen (manufactured by Polytan); Prestige (manufactured by Tarkett Sommer Sports Systems); and DD Soccer Grass (manufactured by Desso Dlw Sports Systems).

The reference number 5 designates, as a whole, a machine (of a known type) designed for dispensing or laying on the starting material designated by 1, 2 a mass of filling material or infill 3 (of a type in itself known), consisting, for example, of a substantially homogeneous mass of a plastic material of the type already described previously. The aforesaid filling material or infill is dispersed amongst the filiform formations 2, so as to keep the filiform formations 2 in a substantially upright condition.

As far as laying or "sowing" of the particulate material 3 is concerned, various considerations must be taken into account.

In the first place, as has already been said repeatedly herein, the solution according to the invention is applicable also to synthetic-grass cover for which the distribution of an infill material 3 is not envisaged.

In the second place, the aforesaid operation of "sowing" or distribution of the particulate material can be performed, according to a solution currently adopted in the art, in field, i.e., after the substrate material 1, 2 has already been laid on the subfloor (designated by G in FIG. 1), i.e., after the aforesaid substrate material 1, 2 has already been laid in the place of installation of the synthetic-grass flooring. In this case, the source 5 for delivering the starting material 1, 2 typically assumes the structure of a mobile dispensing unit designed to advance gradually over the substrate material 1, 2 to carry out the operation of "sowing" of the particulate material 3.

Associated to the dispensing unit 5 there may be a further unit (not illustrated in the drawings, but of a known type) basically configured as a rake or similar implement, the function of which is to pass in front of the dispensing unit 5 in the relative movement of advance with respect to the substrate material 1, 2, in such a way as to enable the substrate material 1, 2 to be pre-arranged in the most favourable conditions for receiving the granular material 3 by causing the filiform formations 2—which, at the moment have a substantially rectilinear pattern—to be oriented substantially in a vertical direction, hence in a direction orthogonal to the general plane of extension of the substrate material 1.

However, the operation of "sowing" the particulate material 3 can be performed in a particularly advantageous way, together with the operation of curling the filiform formations, which will be described in greater detail hereinafter, in an industrial environment, i.e., in the context of a single production line, where, starting from the substrate material 1, 2, a final material is obtained that comprises the aforesaid substrate material plus the particulate infill 3. The above is provided in the form of a material in sheets and/or rolls that can be stored and sent to the place where it is to be laid, in order to be installed by means of an operation that basically involves only the direct intervention of laying the product out on the subfloor, without any longer having to carry out the sowing operation in field.

As has already been said previously, both the criteria that determine the choice of the substrate material 1, 2 and the criteria for carrying out the operation of sowing the particulate material 3 (including the choice of the characteristics of said material) correspond to solutions which are in themselves known and hence do not constitute a specific subject of the present application.

After completing the operation of "sowing" the particulate material 3 and, consequently, after providing a structure that can basically be likened, for instance, to the one described in EP-A-1 158 099, according to an important feature of the present invention, an operation of curling or "texturing" the distal parts 2*b* of the filiform formations 2 is carried out. The aim of the above is to bestow upon the filiform formations the general tree-like appearance illustrated in FIG. 1.

In the currently preferred embodiment of the invention, the aforesaid result is obtained by applying a flow of heated aeriform substance. The said flow of aeriform substance may be simply a flow of heated air generated by a pumping element 6 basically consisting of a fan with associated thereto a heating source. It may typically be represented by an industrial fan-heater or, possibly, a heating source obtained by modifying a gun-type heating apparatus, such as a blow-torch of the sort currently used, for example, by persons who install waterproof sheeting.

As has already been said previously, the operation of directing a flow of heated air onto the distal portions 2*b* of the filiform formations 2 in order to cause the said distal portions, which preferably consist of thermoplastic material, such as polyolefin material, to curl may be performed even after the synthetic-grass flooring has been laid. This is done typically after sowing of the particulate material 3 (if envisaged).

The aforesaid polyolefin material may be chosen in the category of the materials already currently in use for making synthetic-grass structures. For instance, it may be polyethylene (with a softening temperature in the region of 70-100° C. according to the density), polypropylene (with a softening temperature in the region of 130-160° C., once again according to the density), or else copolymers of various nature (with softening temperatures usually comprised within the extreme limits defined above).

It will moreover be appreciated that carrying out the operation of heating in the context of the production line of an industrial plant, and hence on line, usually after the operation of sowing of the particulate material 3 proves advantageous for various reasons.

The above applies, in particular, as regards the choice and maintenance of conditions of strict tolerance in regulating parameters, such as the temperature and flow rate of the aeriform substance, the distance between the source 6 and the synthetic-grass structure that undergoes the curling treatment, etc. The above are, in fact, parameters which, according to the characteristics of the filiform formations 2 (their length, in particular as regards the length of the portion that projects above the mass of infill 3, the material constituting the filiform formations, and the dimensions of the filiform formations) determine the degree of curling bestowed upon the distal portions 2*b* of the filiform formations 2.

The choice of using, as heating source, a fan-heater or a similar device constitutes just one of the possible choices for achieving the described result.

The use of a fan-heater is currently considered preferential. There is, in fact, reason to believe that the turbulent flow of air induced upon the synthetic-grass structure has a beneficial effect in facilitating curling of the filiform formations. As an alternative, it is possible to consider static heating sources, such as, for instance, infrared lamps or other sources of heating by irradiation.

When a fan-heater is used as heating source 6, the degree of the phenomenon of curling induced on the distal ends 2*b* of the filiform formations 2 depends, all other parameters being equal (dimensions of the filiform formations, constituent material, temperature of the flow of aeriform substance, etc.), upon the relative rate of feed of the treated web-like material with respect to the heating source 6.

By adjusting the above parameter (of course, jointly with the other parameters referred to previously), it is thus possible to regulate the degree of curling achieved in a very precise way.

In this connection, different choices may be made depending upon the applicational requirements.

For instance, for applications such as tennis courts, it is usually preferable to obtain a rather high degree of curling, so as to give rise, at the top surface of the synthetic-grass cover, to a rather compact intertwining of curly fibres.

In other applications, such as soccer fields or American-football fields, a smaller degree of curling is usually preferred.

Tests so far carried out by the present applicant show that it may be advantageous not to push the heat treatment up to the point of obtaining a connection due to melting between adjacent filiform formations.

Instead, in applications where it is desired to obtain a top surface of the grass cover that is rather compact, it may be advantageous to protract heat treatment up to the point of obtaining an at least marginal connection between adjacent filiform formations.

Without wishing to be tied down to any specific theory in this connection, the applicant has reasons to believe that the excellent qualities of resistance to wear revealed by a synthetic-grass flooring made according to the invention are provided by the fact that, instead of standing upright in a substantially vertical direction, the distal ends 2*b* of the filiform formations 2 as a whole lie flat, at least for part of their length in the direction of extension of the synthetic-grass flooring The above means that the loads applied by treading do not result in violent shearing stresses, but assume, instead, the character of a compressive and/or flexural stressing of the intertwined curly ends.

When the embodiment of the synthetic-grass flooring envisages the use of the infill, an important characteristic of the solution according to the invention, which is linked to the general bushy shaping attributed to the filiform formations 2 by subjecting their distal ends 2*b* to curling, is provided by the fact that, once the particulate infill 3 has been sown amongst the filiform formations 2 which are then subjected to curling at their top ends 2*b*, it is, so to speak, trapped between the sheet substrate 1 and the intertwined curly ends 2*b* of the filiform formations 2.

The above result, which is, however, beneficial when sowing of the particulate material 3 and curling of the top ends of the filiform formations 2 are performed in field, i.e., after laying of the synthetic-grass flooring, is of determining importance when, in the currently preferred embodiment, the aforesaid operations of sowing and curling of the filiform formations are carried out in the context of an industrial plant.

Since the particulate material 3 is trapped up against the sheet substrate 1, the product leaving the workstation, after the operation of curling (indicated by 8 in FIG. 2), can be handled without risk of the particulate material 3 separating from the product thus obtained and hence being dispersed.

The above result may be rendered even more evident in the case where the particulate material is in some way rendered at least slightly cohesive, for example by the addition of a bonding agent or by subjecting the layer of particulate material 3, once sown, to a treatment of contained compression.

The product coming out of the curling station or heating source 6 of FIG. 2 constitutes, to all effects and purposes, a complete synthetic-grass covering that can be made in the form of sheets or strips which can then possibly be wound in the form of rolls, as is schematically indicated by the reference number 7 in FIG. 2.

The material in rolls thus obtained can be stored in view of a subsequent delivery to the place where it is to be laid.

In order to lay the synthetic-grass flooring, it is sufficient to unroll the material onto the subfloor, which is prearranged for this purpose, without having to carry out in field either the operation of sowing the infill 3 or the operation of curling of the top or distal ends of the filiform formations 2. Allied to the above is the advantage of having available a material which, having been made completely in the factory, presents given characteristics that are altogether precise and reliable.

Of course, without prejudice to the principle of the invention, the details of construction and the embodiments may vary widely with respect to what is described and illustrated herein, without thereby departing from the scope of the present invention as defined in the ensuing claims.

The invention claimed is:

1. A process for making a synthetic-grass covering, comprising the operation of providing a substrate with a plurality of filiform formations that extend from the substrate to simulate natural-grass cover or sward, said filiform formations being provided with respective proximal ends and distal ends with respect to the substrate, the process comprising the operation of selectively curling only said distal ends by application of a heated flow to said distal ends, bestowing upon said filiform formations a general tree-like conformation.

2. The process according to claim 1, further comprising the operation of providing said application of heat by means of a flow of a heated aeriform substance.

3. The process according to claim 1, wherein said distal ends of said filiform formations undergo curling after the synthetic-grass covering has been laid.

4. The process according to claim 1, wherein said distal ends of said filiform formations undergo curling before the synthetic-grass covering has been laid.

5. The process according to claim 1, further comprising the operation of dispersing a particulate filling material or infill amongst said filiform formations so as to maintain the latter in substantially upright conditions.

6. The process according to claim 5, further comprising the operation of dispersing said particulate infill amongst said filiform formations before subjecting said distal ends of said filiform formations to curling.

7. The process according to claim 1, further comprising the operation of making said filiform formations starting from a polyolefin material.

8. The process according to claim 1, further comprising the operation of making said filiform formations starting from a bulk-pigmented material.

9. The process according to claim 1, wherein said treatment of curling said distal ends of said filiform formations is performed without causing the setting-up of points of connection between distal ends associated to different filiform formations.

10. The process according to claim 1, wherein said treatment of curling said distal ends of said filiform formations is performed causing at least marginal connection between distal ends associated to different filiform formations.

11. The process according to claim 5, further comprising the operation of rendering at least partially cohesive said particulate infill.

12. The process according to claim 11, wherein said particulate infill is rendered at least partially cohesive by the addition of a bonding agent.

13. The process according to claim 11, wherein said particulate infill is rendered at least partially cohesive by a treatment of compacting.

14. The process according to claim 5, wherein said operation of dispersing a particulate filling material or infill and said subsequent treatment of curling of the distal ends of said filiform formations are performed as successive steps of an industrial manufacturing process.

15. The process according to claim 14, further comprising the operation of winding said synthetic-grass covering comprising said particulate infill withheld on said substrate by said tree-shaped filiform formations in the form of a material wound in rolls.

16. A synthetic-grass flooring comprising a substrate with a plurality of filiform formations extending from the substrate for simulating natural turf or sward, said filiform formations being provided with respective basically rectilinear proximal ends and respective distal ends, wherein only said distal ends are substantially curled by application of a heated flow to said distal ends, so that said filiform formations have a general tree-like conformation.

17. The synthetic-grass flooring according to claim 16, wherein said filiform formations are made of thermoplastic material.

18. The synthetic-grass flooring according to claim 16, wherein said distal ends of said filiform formations are made of material rendered curly after laying of said synthetic-grass flooring.

19. The synthetic-grass flooring according to claim 16, wherein said distal ends of said filiform formations are made of material subjected to curling before laying of said synthetic-grass flooring.

20. The synthetic-grass flooring according to claim 16, further comprising a particulate infill dispersed amongst said filiform formations so as to maintain said filiform formations in a substantially upright condition.

21. The synthetic-grass flooring according to claim 20, wherein said particulate infill is a material dispersed amongst said filiform formations before said distal ends of said filiform formations are subjected to curling.

22. The synthetic-grass flooring according to claim 16, wherein said filiform formations are made of a polyolefin material.

23. The synthetic-grass flooring according to claim 16, wherein said filiform formations are made of a bulk-pigmented material.

24. The synthetic-grass flooring according to claim 16, wherein said distal ends of said filiform formations are subjected to curling without causing points of connection between distal ends associated to different filiform formations.

25. The synthetic-grass flooring according to claim 16, wherein said distal ends of said filiform formations are subjected to curling to cause at least marginal points of connection between distal ends associated to different filiform formations.

26. The synthetic-grass flooring according to claim 20, wherein said particulate infill is at least partially cohesive.

27. The synthetic-grass flooring according to claim 26, wherein said particulate infill contains an added bonding agent.

28. The synthetic-grass flooring according to claim 26, wherein said particulate infill is a material subjected to compacting.

29. The synthetic-grass flooring according to claim 20, in the form of the finished product of an industrial manufacturing process comprising said infill withheld on said substrate by said curly distal ends of said filiform formations.

30. The synthetic-grass flooring according to claim 29, in the form of a sheet or strip material wound in rolls prearranged for laying on a subfloor.

31. A process for making a synthetic-grass covering, comprising the operation of providing a substrate with a plurality of filiform formations that extend from the substrate to simulate natural-grass cover or sward, said filiform formations being provided with respective proximal ends and distal ends with respect to the substrate, the process comprising the operation of selectively curling only the distal end of at least one filiform formation by subjecting at least said distal end to a first temperature greater than a second temperature of at least a portion of said at least one filiform formation.

* * * * *